United States Patent [19]

Stol et al.

[11] Patent Number: 4,639,992

[45] Date of Patent: Feb. 3, 1987

[54] CORROSION RESISTANT STEAM GENERATOR AND METHOD OF MAKING SAME

[75] Inventors: Israel Stol, Mount Lebanon; Robert H. Appleman, Pleasant Hills, both of Pa.

[73] Assignee: Westinghouse Electric Corp., Pittsburgh, Pa.

[21] Appl. No.: 778,950

[22] Filed: Sep. 23, 1985

Related U.S. Application Data

[62] Division of Ser. No. 563,899, Dec. 21, 1983, Pat. No. 4,579,087.

[51] Int. Cl.[4] ..... B21D 53/00; B23P 15/26

[52] U.S. Cl. ..... 29/157 R; 29/157.3 C; 29/157.4; 165/134.1; 165/173; 228/164

[58] Field of Search ..... 29/157 R, 157.3 R, 157.3 C, 29/157.4, 33 G, 282; 165/134.1, 173; 228/164, 173 F, 174

[56] References Cited

U.S. PATENT DOCUMENTS

| | | | |
|---|---|---|---|
| 1,102,163 | 6/1914 | Opperud | 29/157 A |
| 2,209,975 | 8/1940 | Jacobus | 29/157.4 |
| 2,449,616 | 9/1948 | Pennella | 165/173 |
| 2,735,698 | 2/1956 | Brinen | 165/173 |
| 2,806,718 | 9/1957 | Cook et al. | 165/134.1 X |
| 3,349,465 | 10/1967 | La Pan et al. | 29/157.4 X |
| 4,192,374 | 3/1980 | Hayden | 29/157.4 X |
| 4,396,059 | 8/1983 | Banner et al. | 165/134.1 |
| 4,579,171 | 4/1986 | Stafford et al. | 165/173 X |

FOREIGN PATENT DOCUMENTS

| | | | |
|---|---|---|---|
| 1507833 | 4/1978 | United Kingdom | 165/134 R |

*Primary Examiner*—Mark Rosenbaum
*Assistant Examiner*—R. S. Wallace
*Attorney, Agent, or Firm*—Daniel C. Abeles

[57] ABSTRACT

A method for fabricating a steam generator and a steam generator wherein primary coolant tubes are sleeved in and in the vicinity of a tubesheet. A smooth transition region is formed between stock primary coolant tubes and sleeved portions thereof in such a manner that no sites for accelerated corrosion are formed. In addition, an adequate volume of material is provided in the transition region to withstand thermal and mechanical stresses and chemical attack. The sleeved tube is preferably thermally treated for improved corrosion resistance.

17 Claims, 11 Drawing Figures

CORROSION RESISTANT STEAM GENERATOR AND METHOD OF MAKING SAME

This is a division of application Ser. No. 563,899, filed Dec. 21, 1983, now U.S. Pat. No. 4,579,087 issued on Apr. 1, 1986.

FIELD OF THE INVENTION

The present invention relates to corrosion resistant steam generator tubes and more particularly to a steam generator for a nuclear steam supply system where the generator tubes are configured with sleeves in the region adjacent the tube sheet.

BACKGROUND OF THE INVENTION

Corrosive attack from concentrations of caustic chemicals has been known to occur in nuclear steam generator heat transfer tubing at and near the tube sheet. The attack is aggravated by the presence of residual stresses in the tubing that may be induced during manufacture by rolling of the tube into the tube sheet. The highest stresses usually occur at the transition from the rolling termination to the unrolled tube which is usually near the surface of the tube sheet facing the incoming tubing. Presently, operating chemistry is the major one defense against such caustic attack. Another defense is thermal treatment of the tubing as a last phase of manufacture at the tube mill to increase its resistance to chemical attack. It is also known to sleeve the tube in and adjacent to the tube sheet in order to provide two distinct barriers to corrosion.

Unfortunately, with some prior art sleeve designs, the connection between the tube and the tube sheet does not adequately defend against corrosion and in some cases, the designs utilized are not structurally adequate to withstand thermal and mechanical stresses.

Droin, in U.S. Pat. No. 4,071,083, discloses a tubular heat exchanger where the tubes are provided with short ferrules of austenitic stainless steel which are welded end to end with the tubes. Such a configuration provides only a single layer corrosion barrier and introduces a potentially troublesome tube weld inside the tube sheet.

Chapman, in U.S. Pat. No. 2,966,340, discloses a steam generator which uses corrosion resistant sleeves positioned over the ends of the tubes and connected to the tubing by brazing. The sleeve ends of the tubes are then expanded into a bore in a tube sheet and welded in place. Chapman is typical of the fillet type of joint wherein an abrupt transition occurs between the reinforced and nonreinforced portions of the tube which, as further explained below, tends to result in corrosion and structural problems.

Young, in U.S. Pat. No. 2,368,391, discloses thick-walled sleeves which are brazed to the ends of thin-walled copper tubing at the ends where the tubes are inserted into the tube sheet of the heat exchanger. The sleeves are then welded to the tube sheet thus preventing the "burning" of the thin-walled tube during bonding to the relatively thick tube sheet.

Rosenblad, in U.S. Pat. No. 2,349,792, discloses a method for replacing tubes in a tube sheet of a heat exchanger. The resulting tube-to-tube sheet connection has an abrupt transition at the connection which gives rise to the above-mentioned structural and corrosion problems.

Jacobus, in U.S. Pat. Nos. 2,209,974 and 2,209,975, discloses a tubular heat exchange apparatus having a tube-to-tube sheet connection for preventing any loosening of the tubes during high-pressure, high-temperature operation. The connection comprises a swaged tube end having ribs and a ferrule sleeve telescoped over the swaged tube end, the ferrule sleeve fitting tightly over the ribs so as to be spaced from the tube. The ferrule is then welded to the tube and swaged and expanded into a hole in the tube sheet. The ferrule and the tube end are designed to be able to expand differentially so that the tubes can expand against and contract from the ferrules.

Brown, in U.S. Pat. No. 1,856,618, discloses an air or gas heat exchanger having air or gas carrying finned tubes which are easily removable from the tube sheets. A sleeve is positioned in a hole in the tube sheet which is of sufficient diameter to allow the fins to be pulled through the hole. When the sheet is removed, the tube can be withdrawn through the hole.

The prior art fails to teach a steam generator having a connection between a length of stock steam generator tubing, a sleeve member, and a tube sheet where the connection and a transition formed between the stock tubing and the sleeve are designed to avoid the introduction of corrosion sites or structural weaknesses.

SUMMARY OF THE INVENTION

It is therefore an object of the present invention to provide a nuclear steam generator with a corrosion resistant connection between the tubes and the tube sheet.

It is a further object of the present invention to provide a connection with a smooth transition between a sleeved heat exchange tube and a tube sheet in a steam generator to thereby avoid introducing corrosion sites or adverse structural configurations.

It is a still further object of the present invention to provide a joint between a heat exchange tube and a tube sheet that can be more readily welded than a fillet type joint and which is easier to inspect after welding, both from inside and outside the tube, than a fillet type joint.

It is a still further object of the present invention to provide a tube-to-tube sheet joint that is self aligning and self fixing.

It is also an object of the present invention to provide a double pressure and corrosion barrier in a primary coolant tube in and at the vicinity of the tube sheet of a steam generator.

In accordance with the preferred embodiment of the present invention, these and other objects are accomplished by providing a steam generator assembly having a primary coolant inlet and a primary coolant outlet chamber. A secondary coolant chamber is also provided. At least one primary coolant tube passes through the secondary chamber and has end portions which are connected to the inlet and outlet chambers. A tube sheet separates the inlet and outlet chambers from the secondary coolant chamber. The tube sheet has passages disposed therein adapted to receive the end portions of the primary coolant tube. The primary coolant tube has a double corrosion barrier at the end portions at and near the tube sheet which comprises a sleeve, coaxially disposed about the end portions of the primary coolant tubes. A transition region is provided between the stock tube and the double corrosion barrier portions. The transition region forms a dimensionally smooth transition between the stock tube and the double corrosion barrier which is free from corrosion acceleration sites and which has an adequate volume of material to withstand thermal and mechanical stresses and chemical attack. As used herein, the phrase "stock tube" is intended to mean the bulk of the primary coolant tube disposed in the secondary coolant chamber which basically includes the tubing between the transition regions. In addition, the term "dimensionally smooth" is intended to mean a smooth and gradual variation in the thickness of the tube wall with no abrupt dimensional changes such as those commonly found in fillet welds.

In another aspect, the present invention comprises a method of fabricating a steam generator having an inlet and outlet chamber and a secondary coolant chamber and at least one primary coolant tube which passes through the secondary chamber and connects the inlet to the outlet chamber. The method comprises the step of upsetting the ends of the stock primary coolant tube to form a transition region in the ends which has a smoothly varying wall thickness. The outside diameter of a portion of the upset ends of the stock tubing is then reduced to a diameter which will accept a sleeve member. The sleeve member is then installed on the reduced outside diameter portion and any space between the sleeve member and the reduced outside diameter portion is closed so that the tube and the sleeve intimately contact each other along their interface. The sleeve is then welded to the tube to form a sleeve and tube assembly. The sleeve and tube assembly is inserted into a passage in a tube sheet which is adapted to be disposed between the inlet and outlet chambers and the secondary chamber. The sleeve and tube assembly is then welded to the tube sheet. This weld forms a leak barrier as well as a rigid metallurgical connection between the tube and sleeve assembly and the tube sheet.

Additional objects, advantages and other features of the invention will be set forth in part in the description which follows and in part will become apparent to those skilled in the art upon examination of the following or may be learned by practice of the invention.

BRIEF DESCRIPTION OF THE DRAWINGS

The accompanying drawings, which are incorporated in and form a part of the specification illustrate various embodiments of the present invention and, together with the description, serve to explain the principles of the invention. In the drawings.

DETAILED DESCRIPTION OF THE INVENTION

Reference will now be made in detail to the presently preferred embodiments of the invention, examples of which are illustrated in the accompanying drawings.

Figure 1:
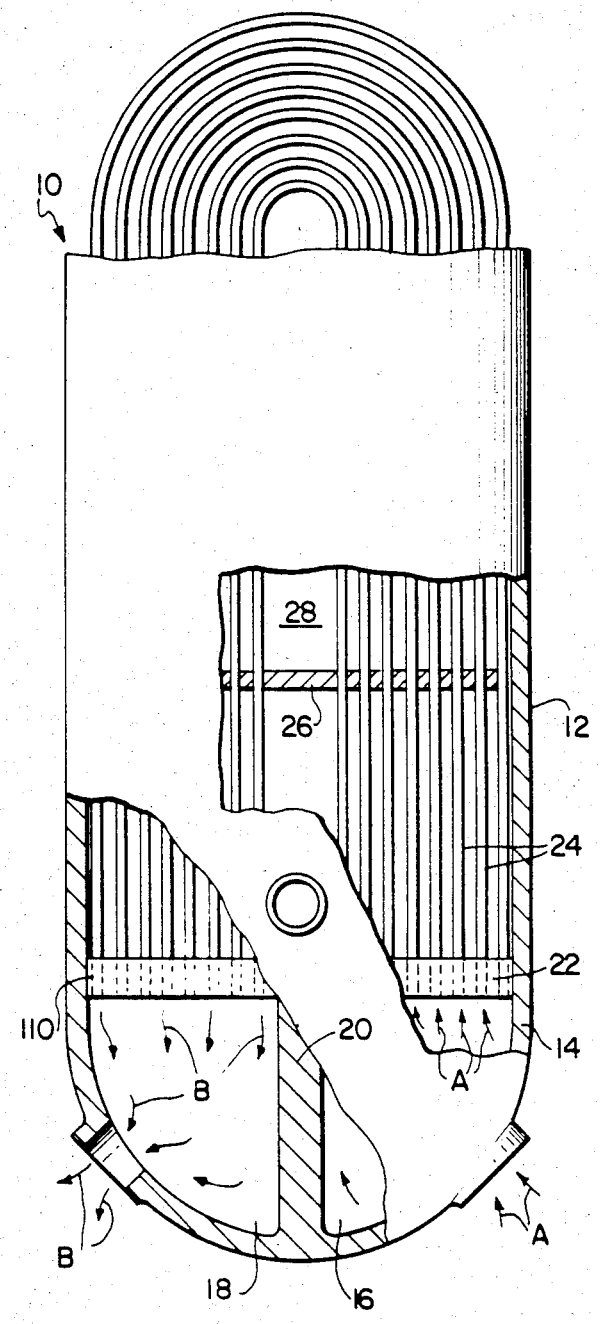
FIG. 1 is an elevation, and partial section of a schematic representation of a typical steam generator.

Referring first to FIG. 1, there is illustrated an exemplary steam generator for use in connection with a nuclear powered electrical generating facility. The steam generator 10 has a generally cylindrical outer shell 12 for containing fluids such as reactor coolant under high pressure. A lower portion 14 of the steam generator is preferably hemispherical in shape and is divided into generally quarter-spherical shaped inlet and outlet chambers, 16 and 18 respectively, by a generally vertical wall structure 20. A generally flat plate 22 is disposed within the steam generator 10 to divide its internal space into two major regions. The plate 22, hereinafter referred to as a tube sheet, has a plurality of passages extending through it. Each of the passages are shaped and sized to receive an end of a generally U-shaped tube 24 which extends from the tube sheet 22 in a generally upward direction, and which, after traversing a generally U-shaped path through the secondary coolant chamber 28, provides fluid communication between the inlet and outlet chambers 16 and 18. As indicated by the arrows A and B, a primary fluid, typically reactor coolant can therefore pass into the inlet chamber 16, upwardly into the tubes 24, through the secondary chamber 28, and exit from the outlet chamber 18. This flow of reactor coolant is at an elevated temperature from having passed through the core of a nuclear reactor and may therefore contain radioactive particles.

As will be appreciated by the artisan, any fluid in the upper portion 28 of the steam generator 10 will be in thermal communication with the outer surface of the tubes 24. Such fluid is commonly referred to as secondary coolant. The thermally hot reactor coolant passing through the tubes 24 will be in a heat exchange relationship with the secondary coolant in the secondary portion 28 of the steam generator 10 for the period of time it takes to pass through the tubes 24. Since the reactor coolant is radioactive, it is important that the secondary coolant be prevented from coming in direct contact with it.

It should be apparent from the above description that a steam generator 10 as illustrated in FIG. 1 permits secondary coolant to be heated by the reactor coolant without the two coming into contact. Although not shown in FIG. 1 and not a part of the present invention, the steam generator 10 may be provided with a means for removing steam from the secondary portion 28 and conducting that steam to a steam turbine which is associated with an electrical generator. The tubes 24 may be preferably supported agains vibration or deformation by intermediate support plates 26 and are rigidly attached to the tube sheet 22 at their end portions. The tubes 24 are welded to the tube sheet 22 in such a way that no fluid can pass through the tube sheet 22 without passing through the tubes 24.

It has been found in practice that over long periods of operation, sediments can be deposited from the secondary coolant onto the upper surface of the tube sheet 22 and around the end portions of the tubes 24. These sediments, which may form sludge, consist mainly of iron oxides but are not so limited. The existence of the sludge contributes to corrosion of the tubes 24. Even when the chemical nature of the sludge itself is not corrosive, artificial crevices may be created between the sludge and the tubes which act as corrosion accelerators. A crevice around the tube 24 is a chemical concentrating situation which can lead to eventual corrosion of the tubes. It should be apparent that corrosion of the tubes 24 can lead to failure of their integrity and permit mixing between the primary and secondary coolant. This, of course, would result in costly downtime to effect the necessary repairs.

While sludge removal techniques may be employed to minimize any failure hazard, a more corrosion resistant design for the tube ends is also necessary to ensure the long term integrity of the steam generator. Although various end fittings between the heat exchange tubes and tube sheets, as discussed above, have been proposed, the present invention offers significant advantages over them in terms of corrosion resistance, ease of fabrication, and post-fabrication inspection.

Turning now to FIGS. 2A–G, there is depicted the development of a first smooth weld, smooth transition, sleeved tube embodiment of the invention. It should be understood that according to the present invention, a connecting region between the tube 100 and a sleeve 102 is formed having a transition region 104 which avoids the introduction of any unacceptable corrosion acceleration sites or adverse structural conditions in the steam generator assembly. The tube 100 of FIGS. 2A–G corresponds to the U-shaped tubes 24 of FIG. 1. An important aspect of the present invention is the development of a smooth, reinforced, transition region 104 where the diameter of the tube 100 is reduced from a general or stock tube size 106 to a narrower inside diameter 108. This transition region is preferably accomplished by swaging or pilgering the tube at a tube mill. The transition should be smooth and retain adequate backup metal in the region where the sleeve-to-tube weld 120 will be effected in the manner discussed below. In this embodiment, the outside diameter of the sleeve 102 is approximately equal to the outside diameter of the tube 100.

The result of the swaging or pilgering or upsetting of the tube end is an end portion of the tube 100 having an increased wall thickness with a reduced inside diameter portion 108. A reduced outside diameter portion 116 (FIG. 2B) may be fashioned from the end portion 110 by machining or the like, to engineer the outside diameter of the tube 100 to a size such that it can easily accept the sleeve 102 as indicated in FIG. 2C.

An exemplary steam generator may use tubes of 0.75 inch outside diameter having a wall thickness of 40 to 50 mils. The corresponding tube sheet passages will be slightly larger, for example on the order of 0.76 to 0.77 inches. A tube sheet 114 (corresponding to the tube sheet 22 of FIG. 1) may be on the order of 15 inches thick so that the size of the openings 112 (FIG. 2F) relative to the tube sheet 114 has been exaggerated in the illustration for clarity. It should also be noted that the transition region 104 preferably extends over a length of about 4 to 6 inches to ensure a smooth and gradual transition. All of the dimensions noted herein are exemplary only and are not intended to limit the scope of the invention in any way.

Figure 2A:
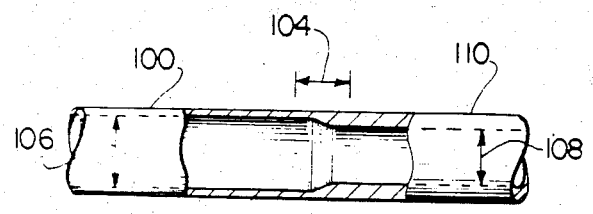
FIGS. 2A–G depict the major steps in the assembly of a sleeved tube steam generator in accordance with a preferred embodiment of the invention where a smooth configuration weld is used to bond a sleeve to a tube in the vicinity of a tube sheet.
Figure 2B:
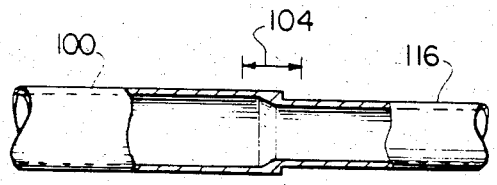
Figure 2C:
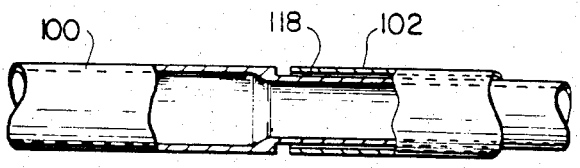
Figure 2D:
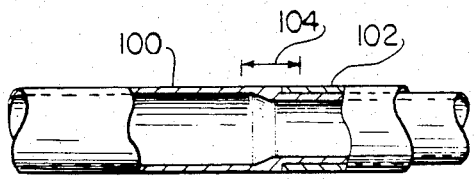

As alluded to above, after machining (FIG. 2B), the sleeve 102 is installed over the reduced diameter portion 116 of the tube 100 as indicated in FIG. 2C. At this point, a small gap 118 may exist between the outside of the machined portion 116 of the tube 100 and the inside of the sleeve 102. The machined portion 116 of the tube is then expanded into intimate contact with the sleeve as depicted in FIG. 2D to eliminate the gap 118. Preferably, during expansion, the gap between the tube and the sleeve is closed along the full surface of the sleeve-tube interface. It should be noted that as the tube is expanded onto the sleeve, the sleeve end and the machined step are maintained in intimate abuttment.

The sleeve 102 is then welded to the tube 100 at a point adjacent the transition region 104 by a weld 120. Preferably, the weld 120 is a laser butt weld. If necessary, the weld 120 is configuration finished by grinding or the like so that the outside of the tube presents a smooth, continuous surface, with no corrosion inducing sites. Inspection by radiograph or the like of the tube to sleeve may be used to verify the integrity of the weld.

The welded assembly is then preferably thermally heat treated to provide the tube, the sleeve material and the weld with good caustic corrosion resistance and for stress relief. In accordance with the present invention, an adequate volume of material is present in the transition region 104 and in the region of the weld 120 to better withstand thermal stress fatigue in general and to reduce stress concentrations at the weld 120 in particular. As described above, the tube-sleeve joint configuration may be described as a partial penetration butt weld with integral backing.

In comparison, prior art fillet joints typically have a short transition region with only a single layer or volume of material in the region of the transition. Due to the geometry of fillet type welds, the tube wall dimensions (that is the difference between the inside and outside diameters) will vary sharply in the transition region. This makes the joint difficult to evaluate both superficially and volumetrically from the improved joint described above. As a result, considerably more time and expense must be expended in reliability testing fillet type weld joints.

While the heat affected zones with the proposed joint (the metallurgically affected regions in the tube transition region and in the sleeve region next to the weld) are essentially exposed for direct inspection, in contradistinction, the heat affected zones with the fillet weld are partially hidden under the fillet. Thus, the joint of the present invention facilitates a cleaner inspection and easier detection of any difficulty with the joint. These benefits are of special importance in connection with in-service inspections.

Moreover, because of the machined surfaces and smoothly finished weld, the sleeve-weld joint of the present invention has better self aligning and self fixing capabilities than fillet joints.

Figure 2E:
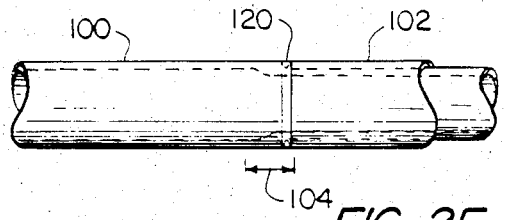
Figure 2F:
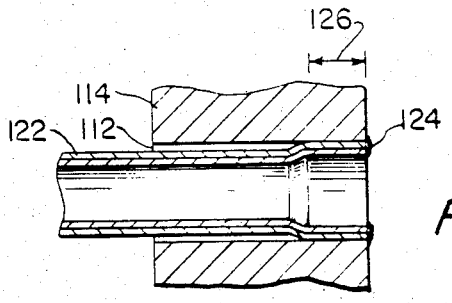

After the tube-sleeve joints are accomplished, the tube and sleeve assembly 122 is bent to generally form a U-shape (if not previously U-shaped) and the assembly is inserted into the tube sheet 114 as shown in FIG. 2F. At least the right-most end of the assembly 122 as viewed in FIG. 2F is tackrolled or otherwise expanded into contact with the passage 112. Once the assembly is properly aligned and positioned in the passage 112, the assembly is welded to the tube sheet 114 at weld site 124. The weld 124 prevents any movement between the tube and sleeve during final assembly and constitutes a leak barrier between the tube 100, the sleeve 102, and the tube sheet 114. In accordance with the general steam generator dimensions referred to above, the tack-roll region may be on the order of two inches of axial tube length.

Figure 2G:
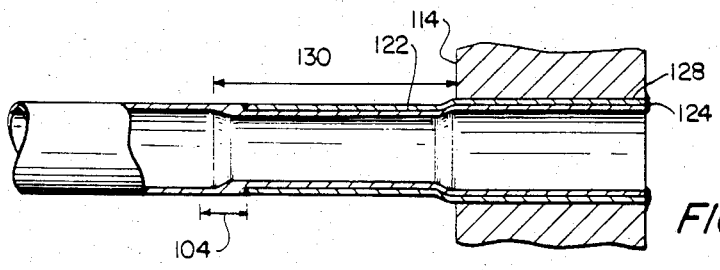

Finally, as indicated in FIG. 2G, the assembly 122 is hydraulically expanded into intimate contact with the tube sheet 114 along the entire interface 128 therebetween. By way of illustration and example only, the interface region 128 may be on the order of 15–20 inches with the entire sleeve having an axial length along the order of 30–40 inches.

As will be appreciated by reference to FIG. 2G, the inside diameter of the steam generator tubes 100 of the present invention will have a "neck" region 130 of slightly reduced inside diameter which may be on the order of 15–20 inches long.

Figure 3:
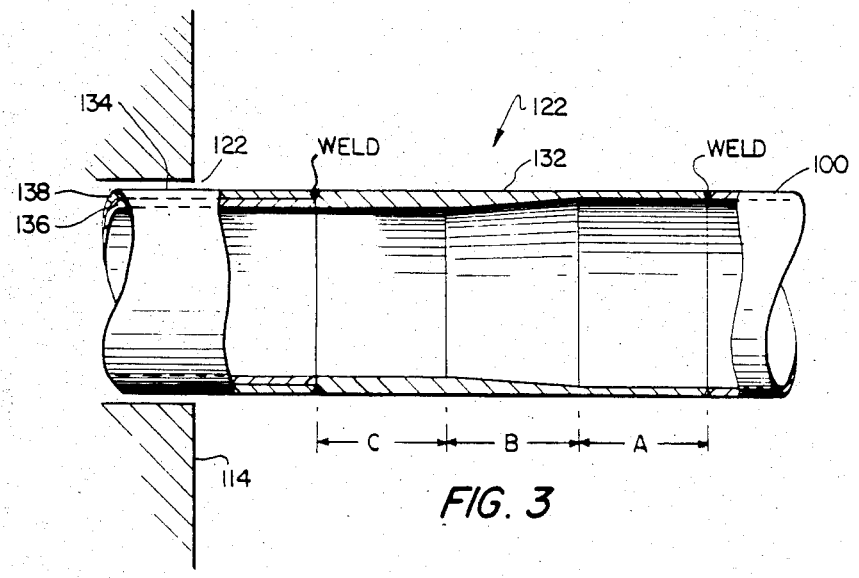
FIG. 3 is a modification of the steam generator tube and sleeve configuration of FIG. 2 where the end of the tube is formed from three discrete segments including stock tubing, a double corrosion barrier segment and a transition segment.

A simplification of the arrangement of FIG. 2G from the fabrication standpoint is depicted in the embodiment of FIG. 3. In FIG. 3, the tube-to-sleeve assembly 122 is formed from three segments. The first segment is the regular tube stock 100. A transition segment 132 is preferably laser butt welded onto the tube 100. The transition segment 132 varies smoothly through the regions A, B and C and is butt welded to a double corrosion barrier tube extension segment 134. The transition segment preferably comprises a first portion A, which dimensionally mates with the stock tube 100. For a six inch transition segment 132, the region A will preferably comprise about two inches. In the region B, the inside diameter of the segment 132 is gradually reduced until it coincides with the inside diameter of the double corrosion barrier tube extension segment 134. For six inch transition segment 132, the region B will preferably comprise about 2 inches.

Finally, the region C dimensionally mates with the double corrosion barrier segment 134. The double corrosion barrier extension segment comprises an assembly of tube material 136 of reduced diameter and a coaxial member 138 of sleeve material which intimately contacts the tube material 136 along the full surface of their interface. The double corrosion barrier extension segment 134 is preferably full penetration laser butt welded to the transition segment 132 and the entire segment thermally treated as described above to improve the caustic stress corrosion resistance of the finished steam generator. This embodiment has several advantages over the first embodiment since conventional machining can be used to square the ends of the various segments rather than machining an outside diameter on the end portion (such as the end portion 116 of FIG. 2B) of a full-length tube which may be several feet long. In addition, the shorter segment simplifies dimensional control and repairs of defective joints.

It is very important to appreciate that weld defects are easier to repair with this embodiment as members can easily be cut away, heat affected zones cut away, ends squared, and the welding repeated. This embodiment therefore represents an excellent general repair method for both the integrally backed joint of FIG. 2 and the double corrosion barrier sleeve and tube extension segment of FIG. 3.

It should also be appreciated that the tube of FIG. 3, when assembled, is inserted, tackrolled welded and expanded in a similar manner to that described above with regard to FIGS. 2F and 2G.

Figure 4:
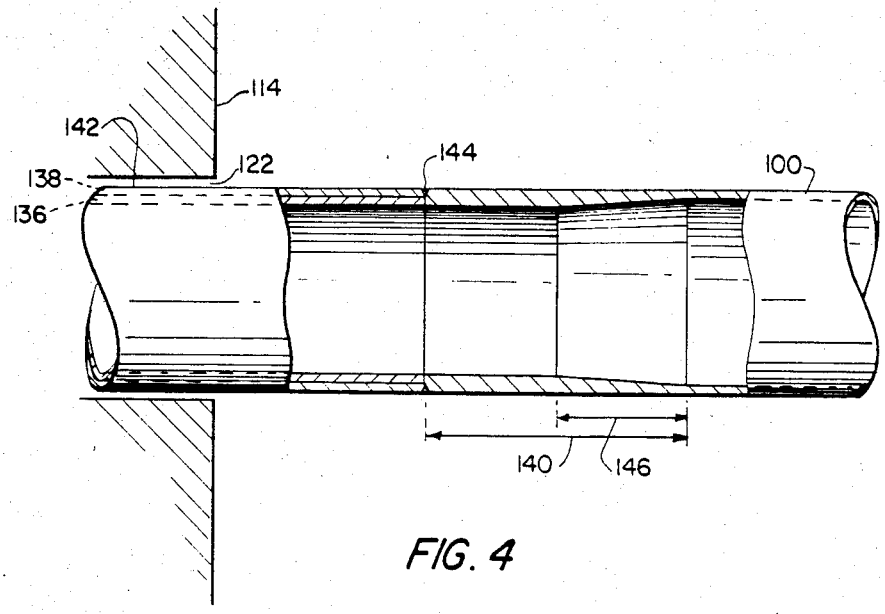
FIG. 4 illustrates the modification of the steam generator tube and sheet configuration of FIG. 2 where a distinct double corrosion barrier segment is welded to the end stock tubing having a transition region formed therein.

The embodiment of FIG. 4 is similar to FIG. 3 except that no separate transition segment is used. In this embodiment, a transition region 140 is formed at the end of the tube 100 but unlike the embodiment of FIGS. 2A–G, the transition region does not continue into a reduced diameter tube portion 116 for the sleeve 102 to be inserted over. Rather, a sleeve and tube assembly 142, similar to the double corrosion barrier 134 of FIG. 3, is preferably full penetration laser butt welded at joint 144 to provide the double pressure and corrosion barrier. Radiography may be employed to verify the integrity of the weld. Within the context of the steam generator dimensions alluded to above, the inside diameter of the tube 100 should vary smoothly at the portion 146 of the transition region 140 over a length of approximately 2 inches for a total transition region of approximately 3 to 10 inches.

The inserting and securing of the double corrosion barrier tube of the embodiment of FIG. 4 into the tube sheet is accomplished in a manner similar to that described above in connection with FIGS. 2F and 2G.

Figure 5:
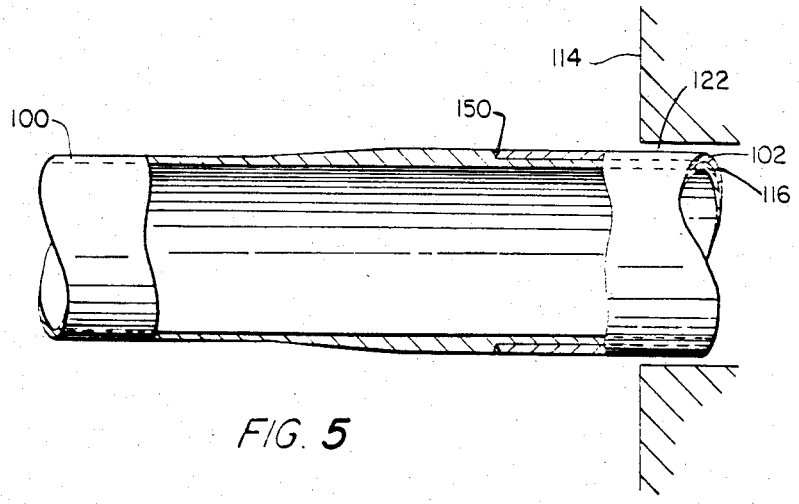
FIG. 5 illustrates the modification of the steam generator tube and sleeve configuration of FIG. 2 where the tube is maintained with a constant inside diameter.

FIG. 5 illustrates a constant inside diameter embodiment of the invention which is similar to the sleeved tube of FIG. 2E except that the outside diameter of the tube 100 is varied to accommodate the sleeve 102 on a machined diameter 116. As with the embodiment of FIG. 2E, the sleeve is butt welded at joint 150 to the tube 100. With the constant inside diameter embodiment of FIG. 5, no neck portion 130, as depicted in FIG. 2G, will be formed in the final tube as assembled in the tube sheet. The steam generator thus formed will have improved hydraulic flow characteristics.

As will be understood by the artisan, the constant inside diameter embodiment of FIG. 5 can also be adapted to the 3-section assembly of FIG. 3 or to the 2-section assembly of FIG. 4 with an appropriately configured sleeve and tube double corrosion barrier assembly butt welded to an appropriately formed tube or transition segment.

The foregoing description of the preferred embodiments of the invention have been presented for purposes of illustration and description. They are not intended to be exhaustive or to limit the invention to the precise forms disclosed, and obviously many modifications and variations are possible in light of the above teachings. The embodiments were chosen and described in order to best explain the principles of the invention and their practical application to thereby enable others skilled in the art to best utilize the invention in various embodiments and with various modifications as are suited to the particular use contemplated. It is intended that the scope of the invention be defined by the claims appended hereto:

We claim:

1. A method of fabricating a steam generator comprising the steps of:

providing inlet and outlet chambers and a secondary coolant chamber and at least one primary coolant tube passing through the secondary coolant chamber and connecting the inlet chamber to the outlet chamber;

positioning a tubesheet between one of said inlet or outlet chambers and the said secondary chamber, said tubesheet having at least one passage therethrough;

upsetting ends of said primary coolant tube to form a transition region in said ends, said transition region having smoothly varying wall thickness;

reducing the outside diameter of a portion of said upset ends to accept a sleeve;

installing said sleeve on said outside diameter portion;

closing any space between said sleeve and said reduced outside diameter portion along an interface therebetween;

welding said sleeve to said primary coolant tube to form a sleeve and tube assembly;

inserting said sleeve and tube assembly into said passage in said tubesheet; and welding the sleeve and tube assembly to the tubesheet.

2. The method of claim 1 wherein the step of welding the sleeve to the primary coolant tube further includes the step of configuration finishing the weld to form a smooth transition between the primary coolant tube outside diameter and the sleeve outside diameter.

3. The method of claim 1 wherein the tube and sleeve assembly is thermally treated after said step of welding the sleeve to the tube.

4. The method of claim 1 wherein the step of inserting further includes the step of expanding at least a lip portion of said sleeve and tube assembly against said tubesheet passage prior to said step of welding the assembly to the tubesheet.

5. The method of claim 4 further including the step of expanding the sleeve and tube assembly against the tubesheet passage after welding said assembly to said tubesheet.

6. The method of claim 5 wherein said step of expanding at least a lip portion comprises tackrolling the sleeve and tube assembly and said step of expanding the sleeve and tube assembly comprises hydraulically expanding said sleeve and tube assembly.

7. A method of fabricating a steam generator comprising the steps of:

providing inlet and outlet chambers and a secondary coolant chamber and at least one primary coolant tube passing through the secondary coolant chamber and connecting the inlet chamber to the outlet chamber:

positioning a tubesheet between one of said inlet or outlet chambers and said secondary chamber, said tubesheet having at least one passage therethrough;

providing, at an end of said primary coolant tube, a double corrosion barrier segment comprising an inner tube member and an outer sleeve member;

providing a transition segment having a first end with inner and outer diameters respectively corresponding to inner and outer diameters of said double corrosion barrier segment, and a second end having inner and outer diameters respectively corresponding to inner and outer diameters of said primary coolant tube, and a transition region of smoothly varying wall dimensions therebetween;

butt welding said first end of said transition segment to said primary coolant tube;

butt welding said second end of said transition segment to said double corrosion barrier segment;

inserting said double corrosion barrier segment into said passage in said tubesheet; and welding the double corrosion barrier segment to the tubesheet.

8. The method of claim 7 further including the step of thermally treating the primary coolant tube after said welding of said segments.

9. The method of claim 7 wheren the step of inserting further includes the step of expanding at least a lip portion of said double corrosion barrier segment against said tubesheet passage prior to said step of welding the double corrosion barrier segment to the tubesheet.

10. The method of claim 7 further including the step of expanding the double corrosion barrier segment against the tubesheet passage after welding said double corrosion barrier segment to said tubesheet.

11. The method of claim 10 wherein said step of expanding at least a lip portion comprises tackrolling the double corrosion barrier segment and said step of expanding the double corrosion barrier segment is accomplished hydraulically.

12. The method of claim 7 wherein the butt welding steps comprise laser butt welding.

13. A method of fabricating a steam generator comprising the steps of:

providing inlet and outlet chambers and a secondary coolant chamber and at least one primary coolant tube passing through the secondary coolant chamber and having end portions connecting the inlet chamber to the outlet chamber:

positioning a tubesheet between at least one of said inlet or outlet chambers and said secondary chamber, said tubesheet having at least one passage therethrough;

providing a double corrosion barrier segment for at least one of said end portions, said double corrosion barrier segment comprising an inner tube member and a coaxial outer sleeve member;

upsetting said at least one end portion of said primary coolant tube to form a transition region having smoothly varying wall thickness, said at least one end portion terminating at inner and outer diameters respectively corresponding to inner and outer diameters of said double corrosion barrier segment;

butt welding said double corrosion barrier segment to said at least one end portion;

inserting said double corrosion barrier segment into a passage in said tubesheet; and welding the double corrosion barrier segment to the tubesheet.

14. The method of claim 13 wherein the tube and double corrosion barrier are thermally treated after said step of butt welding.

15. The method of claim 13 wherein the step of inserting further includes the step of expanding at least a lip portion of said double corrosion barrier against said tubesheet prior to said step of welding the double corrosion barrier segment to the tubesheet.

16. The method of claim 13 further including the step of expanding the double corrosion barrier segment against the tubesheet passage after welding said double corrosion barriers to said tubesheet.

17. The method of claim 13 wherein said step of expanding at least a lip portion comprises tackrolling the double corrosion barrier segment, and said step of expanding the double corrosion barrier segment is accomplished hydraulically.

* * * * *